US005567191A

United States Patent [19]

Gordon

[11] Patent Number: 5,567,191

[45] Date of Patent: Oct. 22, 1996

[54] IMPROVEMENTS RELATING TO LIFE JACKETS

[76] Inventor: Peter C. Gordon, 10 Hollytree Road, Woolton, Liverpool L25 5PA, United Kingdom

[21] Appl. No.: 256,563

[22] PCT Filed: Jan. 14, 1993

[86] PCT No.: PCT/GB93/00066

§ 371 Date: Jan. 20, 1995

§ 102(e) Date: Jan. 20, 1995

[87] PCT Pub. No.: WO93/13978

PCT Pub. Date: Jul. 22, 1993

[30] Foreign Application Priority Data

Jan. 15, 1992 [GB] United Kingdom ..... 9200851

[51] Int. Cl.[6] ..... B63C 9/08

[52] U.S. Cl. ..... 441/117

[58] Field of Search .. 441/88,106,107,112,114,115–119

[56] References Cited

U.S. PATENT DOCUMENTS 3,441,963 5/1969 Steinthal .

4,236,264 12/1980 Britzman .

FOREIGN PATENT DOCUMENTS 0184403 6/1986 European Pat. Off. .

2736432 2/1979 Germany .

2005602 4/1979 United Kingdom .

*Primary Examiner*—Jesus D. Sotelo

*Attorney, Agent, or Firm*—Rohm & Monsanto

[57] ABSTRACT

The invention provides an inflatable life jacket which is held in a horse-shoe shaped cover from which the jacket breaks free when inflated. The jacket has two legs (34, 36) and a rear jacket (44,46). The rear portion (44, 46) fits behind the user's head and the legs (34,36) locate to opposite sides of the user's chest. The legs (34,36) are approximately of equal length, but their inner edges are profiled so that one has a major section (42) which extends across the user's chest and a minor lobe (40) which lies adjacent the user's neck and the other leg (36) has a major lobe (38) which also extends across the user's chest and registers with a narrow portion of the other leg lying between the major section (42) and inner lobe (40) so as to interfit with said narrow portion and to underlie (at least partially) said other leg (36) to prevent the formation of a water channel between the legs (34, 36). the rear portion has extension lobes (44,46) to increase buoyancy behind the head.

8 Claims, 3 Drawing Sheets

IMPROVEMENTS RELATING TO LIFE JACKETS

This invention relates to inflatable life jackets.

Inflatable life jackets are worn by personnel who work in an environment or circumstances where there is the danger or risk that they will have to survive being placed in the sea or another body of water, the life jacket providing the necessary buoyancy to keep the person afloat for long periods. Typically, life jackets may be used by pilots, particularly helicopter pilots and their passengers, services personnel in transit on or over water, and personnel such as off-shore platform workers whose job involves the risk or danger of their being placed in the sea in emergency conditions.

Inflatable life jackets may be loose items which are placed on the person in the event of an emergency, but in more common practise today in relation to those personnel whose work involves constant danger that at any time they may be placed in the sea, the inflatable life jackets are permanently worn in readiness for such emergencies. The inflatable life jacket may be an item which is fitted to the user's body by means of a harness and buckles and the like, or it may in turn be permanently fixed to for example an abandonment suit which is of a type to protect the user against hypothermia in the event that the user in an emergency may have to spend time in the water. This arrangement will be adopted in cases where because of the user's environment emergency circumstances resulting in the person being placed in the water may arise at short notice, the person not having sufficient time to don the abandonment suit and the life jacket.

Because of their function, life jackets have been developed in a number of respects including that the jacket is automatically inflated, for example by a pressure and/or water sensitive device, in the event of the user falling into the water. They may alternatively be inflated by manual actuation of a mechanism which releases the inflating medium. The inflating medium typically is a cartridge of a liquid which is held under pressure and which flashes to a gas upon release of that pressure. Such inflation medium may for example be carbon dioxide.

Furthermore, when the life jacket is carried by the person it is in a collapsed or deflated state, and may be held in a flexible cover or casing which opens in controlled fashion under the inflating influence of the life jacket.

Some life jackets are single cavity jackets, whilst others are double cavity jackets. With a single cavity jacket, two panels of sheet material are secured together around their edges to form the cavity, whilst in a double cavity jacket three layers of sheet material are joined together at their edges, so that the cavities are formed on respective sides of the middle layer of sheet material. Each cavity is associated with an inflation cartridge, and in the case of a double cavity jacket, the operating mechanisms of the cartridges are interconnected so that should either cartridge fail to perform its inflation function automatically, as described above, then the actuation of one of the cartridges and the inflation of its associated cavity causes the operation of the other cartridge mechanism.

Inflatable life jackets fall into three categories, namely single lobe life jackets, asymmetrical life jackets and split front twin lobe life jackets.

The single lobe life jacket is an inflatable body having a head aperture therein, and the user applies the jacket by passing his head through the said aperture. It is not possible for single front jackets to be permanently attached to abandonment suits. When the jacket is inflated, the section of the jacket resting on the chest is inflated and forms the main buoyancy means of the jacket. The disadvantages of the single front life jacket include that it does not allow itself to be attached to a suit; it is more difficult to don; it has a bulk centrally on the chest when packed which can be obstructive; is not particularly comfortable or convenient to wear on a permanent basis, especially if the user also wears an abandonment suit, because he cannot easily open the zip of the abandonment suit which extends centrally downwards of the user's chest. It is noted that for comfort users will often leave the front of the abandonment suit open.

The split front twin lobe life jacket comes in a flexible casing which is horse-shoe shaped and the casing fits around the user's neck. This jacket is much more comfortable to wear, and can either be provided with a harness for coupling the jacket to the user's body, or the casing can be fixed to the abandonment suit. Additionally, such life jackets are often seen on sailing jackets, attached to the jacket at the collar by toggles, the harness being passed through loops on the jacket. Because of the shape of the casing, the user can freely open or close the front of the abandonment suit without interference from the life jacket. When the split front life jacket is inflated, there are two symmetrical frontal sections to the jacket which lie on opposite sides of a line lying centrally downwards of the user's chest, and these sections form the main buoyancy of the jacket. However, providing the jacket in this configuration creates a disadvantage in that when the user is in the water, there is a tendency for the water by virtue of the wave action to ride up a central channel, which is created by the two sections of the life jacket, towards the user's mouth, which can be dangerous especially if the user is unconscious, which is not unusual.

The asymmetric jacket in the collapsed state is contained in a casing which is of U-configuration, but comprises a long leg and a short leg. The jacket in this condition is positioned around the user's neck so that the long leg lies down one side of the user's chest, whereas the short leg simply lies adjacent the user's neck. The casing may again be connected either by a harness or by being fixed to the abandonment suit, the latter case being more usually adopted with this particular construction. When the jacket is inflated, a section of the jacket contained in the long leg expands across the user's chest in being inflated thereby to provide a frontal buoyancy section, somewhat similar to the buoyancy section in the single lobe jacket, which forms the main buoyancy of the jacket. This arrangement avoids the difficulty of waves reaching the user's mouth to the same extent as they do in the split front life jacket but it has its own disadvantages which include that it is not as comfortable to wear as the split front life jacket because of its uneven bulk and weight on each side of the chest and it can have a tendency to fail to self right a user when in water should the user wittingly or unwittingly find himself in the wrong and face-down position in the water (conscious or unconscious) subsequent to the inflation of the jacket. This is because the main buoyancy section of the jacket inevitably is slightly off-set from the user's chest.

The present invention aims to provide a new form of inflatable life jacket which is free from the disadvantages of the various jackets indicated above, and in accordance with the present invention an inflatable life jacket comprises two buoyancy sections respectively for location at opposite sides of the chest but which are asymmetric one relative to the other and which overlap or interfit in the central region of the chest thereby to prevent the creation of a channel for the flow of water towards the user's mouth when in in-use conditions.

The jacket preferably is contained in a U-shaped cover of which the legs are of equal or approximately equal length, and the inflation of the jacket may be on the basis of automatic sensing means and/or by manual operation such as to cause the jacket to open the cover by virtue of the inflation thereof.

When in the inflated condition, the jacket may have as one of said buoyancy sections a major portion which extends across the front of the chest and is located a first distance from the user's neck, whilst the other section on the opposite side of the chest has a major lobe portion which extends across the chest, and is located a second distance from the user's neck which is less than the said first distance, and in fact said lobe is adapted to tuck or wedge under the user's chin in order to keep the head at a desired attitude when the user is in the water.

In fact, by so designing the portion of the jacket which fits round the neck, when it is inflated, it not only keeps the user's head in a desired position, but can assist in tending to close the user's mouth, which is particularly useful when the user is unconscious.

The portion to the rear of the user's head may also be inflated, and may be provided with extension lobes to give enhanced buoyancy to the rear of the head.

The jacket may finally be provided with the usual features such as reflective patches for enhanced visibility, a pressure relief valve to prevent the jacket from being inflated to too high a pressure, one or more oral blow tubes to enable the jacket to be inflated or partially inflated manually, a rescue light with waterproof battery and a warning whistle, lifting becket loop and buddy line.

The life jacket preferably is constructed of conventional life jacket materials selected and treated for strength and waterproofness.

Although the jacket is asymmetrical, nevertheless it is provided with two legs of substantially equal length which makes it comfortable to wear yet provides it with a appropriate buoyancy such as to make the jacket operate in relation to the user in a self-righting manner. This is because the gas cylindr and other equipment of the life jacket can be fitted to the narrower side such that they form a similar weight and bulk to the larger side of the life jacket when packed thus giving a symmetrically balanced feel, weight and bulk. That is to say a person using the jacket when unconscious in the water will be turned to a face-up position by virtue of the substantial buoyancy in front of the chest. Most particularly, by virtue of the asymmetric design of the jacket, the creation of a channel up which water can flow by virtue of wave action and body motion towards the mouth of the user, is avoided.

The jacket may finally be provided with a splash hood which overlies the user's head in order to prevent splashings from reaching a user's mouth.

An embodiment of the present invention will now be described, by way of example, with reference to the accompanying drawings, wherein.

Figure 1:
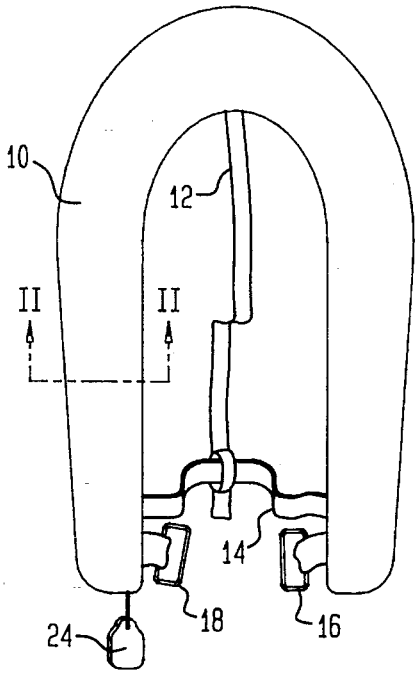
FIG. 1 is a view of a life jacket according to the invention when in the packaged condition inside the jacket casing.

Referring to the drawings, in FIG. 1 a life jacket is shown when contained in an outer casing 10. It can be seen that the jacket is of horseshoe or U-shape, so that it can be fitted around the user's neck. The jacket has a strap harness 12, 14 with buckles 16, 18 to enable the life jacket to be strapped to the user's body to enable adjustment of the harness for proper fit.

In an alternative construction, the life jacket may be releasably fixed or even permanently fixed to the user's abandonment suit.

Figure 2:
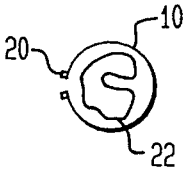
FIG. 2 is a sectional view through the jacket of FIG. 1 taken on the line II—II in FIG. 1.

The outer casing 10 is of stout fabric, and as shown in FIG. 2 is wrapped into tubular form and the free edges are connected by a zip fastening arrangement 20. The inflatable body of the life jacket is indicated inside the tubular casing 10 by the reference numeral 22, and it will be seen that it is in folded and deflated condition.

To inflate the life jacket the user either pulls on an inflation tab 24 connected to a gas cylinder inside the casing 10 (shown at 26 in FIG. 3) which causes inflation of the body 22. As the body 22 inflates, it causes spreading of the zip fastening arrangement 20, and opening of the casing to enable the inflated body to perform its function.

Figure 3:
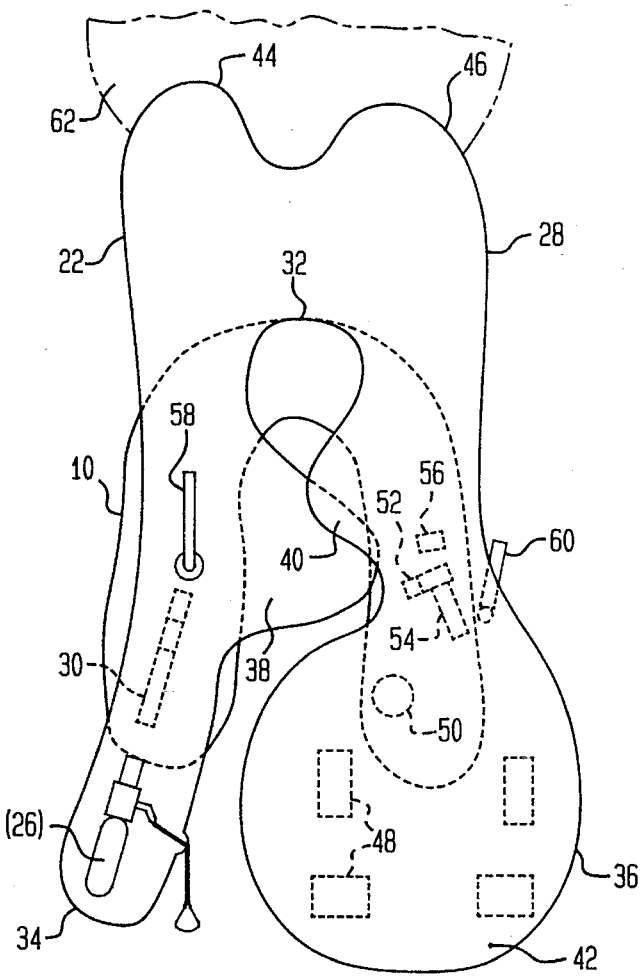
FIG. 3 is a view of the jacket of FIG. 1 when in the open condition (but uninflated)

FIG. 3 shows the arrangement with the casing 10 in open condition, and the body 22 Opened out but in fact not inflated. This representation is adopted in FIG. 3 in order to indicate the profile configuration of the body 22.

The body 22 is made up of layers of impermeable material in the form of flexible sheeting of the type conventionally used for this purpose. Layers of the sheeting are used and are sealed together at the peripheral edge 28 of the body. Where a single cavity inflatable body is to be provided two layers are used for the body, but where a double cavity arrangement is to be provided three layers are used and the layers are welded or otherwise sealed at the edge 28. The respective cavities are formed therefore to opposite sides of the middle layer, and in such case a second gas cylinder 30 is provided for the second cavity. In fact the arrangement shown in FIG. 3 is a double cavity life jacket.

As can be seen from FIG. 3, the body 22 can be described as generally u-shaped but it has a central aperture or recess 32 for receiving the user's neck, and the two legs 34 and 36 are of asymmetric configuration shown.

Leg 34 is provided with a lobe 38 adjacent the neck aperture 32, whilst leg 36 is provided with a neck lobe 40 and a large inflation section 42.

At the top of the body behind the neck aperture 32 there are rearward extension lobes 44 and 46 which provide added buoyancy for the rear of the head as will be explained hereinafter.

The jacket is provided additionally with conventional items such as light reflective patches 48, a pressure relief valve 50 (for each cavity) a beacon light 52, a waterproof battery 54 for the beacon light, and a signalling whistle 56.

Each cavity may be inflated orally by means of the blow pipes 58 and 60.

Finally, the body 22 is provided with a splash hood 62 which can fit over the user's head to prevent splashings from reaching the user's mouth.

Figure 4:
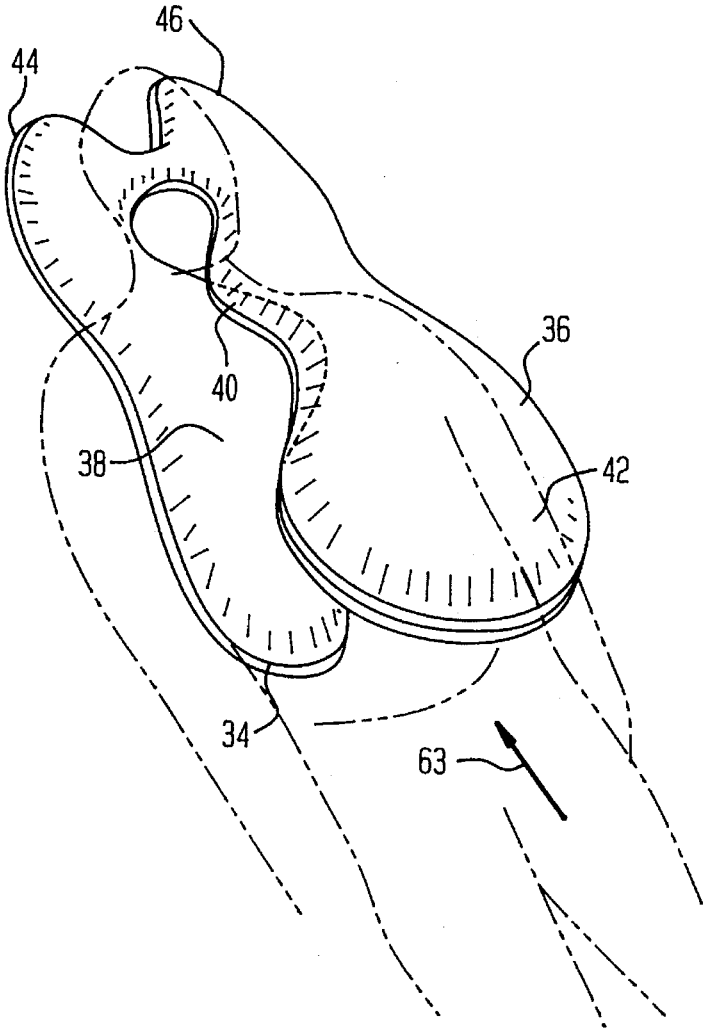
FIG. 4 is a perspective view illustrating the jacket when inflated and in use.

When the jacket is inflated as shown in FIG. 4 and is in use, the lobe 38 of the leg 34 tucks under the lobe 40 and into the concave portion of the leg 36 and the major inflation portion 42 of leg 36 substantially overlies the user's chest. By virtue of the inflation, the edge of the seal 28 defining the aperture 32 wraps tightly round the user's neck keeping the head upright and in fact assisting in keeping the mouth closed should the user be unconscious.

By virtue of the overlapping and/or interlocking arrangement of the legs and the asymmetric design of the legs, waves travelling in the direction of arrow 63 are not channelled towards the user's mouth which is a particular advantage of the design adopted.

Figure 5:
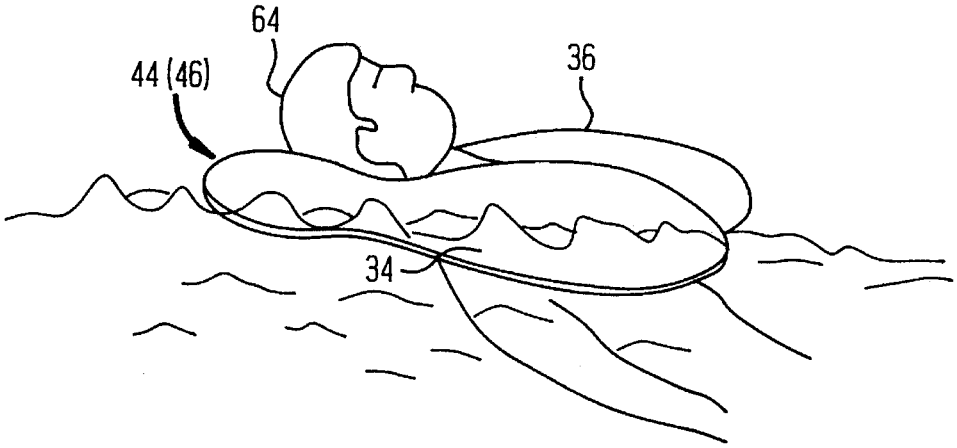
FIG. 5 is a side view of the arrangement shown in FIG. 4.
Figure 6:
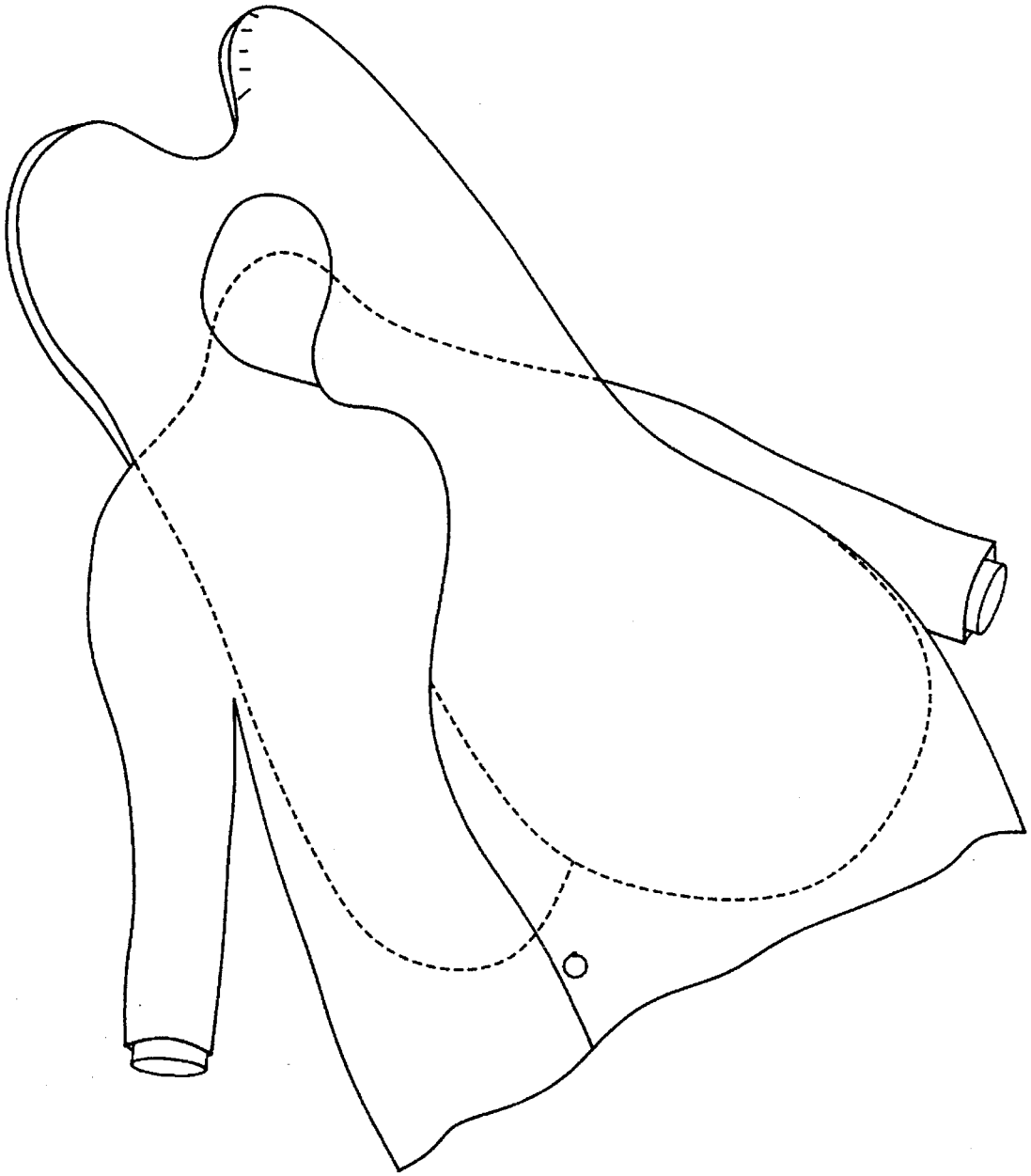
FIG. 6 is a schematic representation of a specific illustrative embodiment of the invention embodied in a garment, the garment being schematically represented.

FIG. 5 shows how the legs 34 and 36 as well as partially overlapping also interfit and together provide a mass of buoyancy in front of the user's chest which means that even if the user turns upside down when in the water, he will eventually self right which is not always the case with the asymmetric jackets of the prior art as explained previously. The rearwardly extending lobes 44 and 46 provide additional buoyancy for the rear of the head 64 as shown in FIG. 5.

A particularly useful inflatable life jacket is therefore provided. It should be noted that the asymmetric profile of the respective legs of the jacket can be varied within the scope of the invention. Instead of the lobes overlapping, they may interlock by appropriate design of the jacket or exhibit both overlocking and interlocking properties at the same time.

The body 22 is preferably housed in the casing 10 in such a manner to ensure that the leg 36 will inflate before the leg 34. This is to some extent achieved by appropriate positioning of the zips and zip sliders, and also by providing that the lobe 38 is provided with a press-stud fastening to fasten it to the remainder of the leg 34 when it is folded into the casing 10, such press-stud being one of the last fastenings to release during the inflation process.

Life jackets according to the present invention can be of any appropriate type. For example they may be designed for helicopter use and be provided with only one gas cylinder and for manual operation only, or they may be of the type comprising two cavities as described with two cylinders for automatic and/or manual operation.

I claim:

1. An inflatable life jacket (10) comprising two buoyancy sections (34, 36) respectively for location at opposite sides of the chest but which are asymmetric one relative to the other, characterised in that the sections (34,36) communicate with one another in a selectable combination of overlap and interfit in the central region of the chest thereby to prevent the creation of a channel for the flow of water towards the user's mouth when in in-use condition.

2. A life jacket according to claim 1, characterised in that one (36) of said buoyancy sections has a major portion (42) which extends across the front of the user's chest and is located a first distance from the user's neck, and the other section (34) has a major lobe portion (38) which extends across the user's chest, and is located a second distance from the user's neck which is less than said first distance.

3. A life jacket according to claim 2, characterised in that said one section (36) has a major lobe (40) spaced from the major portion (42) by a reduced width portion with which the major lobe (38) of the other section (34) registers.

4. A life jacket according to claim 2 characterised in that said portions (34,36) comprises legs (34, 36) of substantially equal length.

5. A life jacket according to claim 1, characterized in that a portion of the jacket which extends to the rear of the user's head (64) is provided with extension lobes (44, 46).

6. A life jacket according to claim 1, characterised in that the jacket (10) is contained in a cover from which it releases upon inflation.

7. A life jacket according to claim 6, characterised in that the cover is substantially horse-shoe shaped with the respective sections (34, 36) on the respective legs of the horse-shoe shape.

8. A life jacket according to claim 6, characterised in that the life jacket is embodied in a user's garment.

* * * * *